US011291597B2

(12) United States Patent
Pettee

(10) Patent No.: US 11,291,597 B2
(45) Date of Patent: Apr. 5, 2022

(54) SYSTEM AND METHOD FOR OPERATING A WHEEL CHAIR

(71) Applicant: Denis Armand Pettee, Rotonda West, FL (US)

(72) Inventor: Denis Armand Pettee, Rotonda West, FL (US)

( * ) Notice: Subject to any disclaimer, the term of this patent is extended or adjusted under 35 U.S.C. 154(b) by 386 days.

(21) Appl. No.: 16/501,675

(22) Filed: May 20, 2019

(65) Prior Publication Data

US 2020/0170856 A1 Jun. 4, 2020

Related U.S. Application Data

(60) Provisional application No. 62/917,373, filed on Dec. 4, 2018.

(51) Int. Cl.
*A61G 5/04* (2013.01)
*A61G 5/10* (2006.01)

(52) U.S. Cl.
CPC ..... *A61G 5/045* (2013.01); *A61G 5/047* (2013.01); *A61G 5/10* (2013.01)

(58) Field of Classification Search
CPC ..... A61G 5/045; A61G 5/047; A61G 5/10; A61G 5/04
See application file for complete search history.

(56) References Cited

U.S. PATENT DOCUMENTS 28,631 A * 6/1860 Cummings ..... F16H 55/17 74/432
3,376,944 A * 4/1968 Lotz ..... A61G 5/045 180/6.5
4,961,473 A * 10/1990 Jones ..... A61G 5/045 180/6.5
5,186,269 A * 2/1993 Avakian ..... A61G 5/1054 180/6.5
5,234,066 A * 8/1993 Ahsing ..... A61G 5/045 180/11
5,253,724 A * 10/1993 Prior ..... A61G 5/1032 180/6.5
5,495,904 A * 3/1996 Zwaan ..... A61G 5/045 180/11
6,050,356 A * 4/2000 Takeda ..... A61G 5/045 180/65.1

(Continued)

*Primary Examiner* — Minnah L Seoh
*Assistant Examiner* — Harold Eric Pahlck, III
(74) *Attorney, Agent, or Firm* — John W. Carpenter

(57) ABSTRACT

An assembly for operating a wheelchair is provided. The assembly has a support frame with a planar support surface and a motor support assembly positioned on the planar support surface such as to be able to slide. The motor support assembly supports a motor which is coupled to a pinion gear. The assembly further has a linkage assembly for coupling the motor support assembly to the support frame. A handle member is coupled to the linkage assembly and is adapted to move the motor support assembly along the planar support surface. A method for engaging gears of a motorized vehicle (e.g. a wheelchair) is also provided. The method comprises moving a handle generally upwardly, which causes the linkage assembly to slide the motor support assembly along the planar support surface of the support frame until the pinion gear engages and meshes with a bull gear of the motorized vehicle.

20 Claims, 5 Drawing Sheets

(56) References Cited

U.S. PATENT DOCUMENTS

| | | | | |
|---|---|---|---|---|
| 6,148,942 | A * | 11/2000 | Mackert, Sr. | B62B 9/00 180/65.6 |
| 6,360,836 | B1 * | 3/2002 | Milano, Jr. | B62B 5/005 180/65.6 |
| 6,408,961 | B1 * | 6/2002 | Chen | A61G 5/02 180/6.5 |
| 8,261,867 | B1 * | 9/2012 | Gainer | A61G 5/047 180/65.6 |
| 9,301,892 | B2 * | 4/2016 | Daigle | A61G 5/026 |
| 10,849,803 | B2 * | 12/2020 | Shim | A61G 5/1054 |
| 2006/0096792 | A1 * | 5/2006 | Usherovich | A61G 5/1054 180/11 |
| 2018/0280213 | A1 * | 10/2018 | Hancock | A61G 5/08 |
| 2021/0220196 | A1 * | 7/2021 | Peskin | A61G 5/047 |

* cited by examiner

SYSTEM AND METHOD FOR OPERATING A WHEEL CHAIR

CROSS-REFERENCE TO RELATED APPLICATION

This is a non-provisional, utility patent application related to Provisional Patent Application having application No. 62/917,373, filed Dec. 4, 2018, inventor Dennis A. Armand, entitled "A System and Method for Operating a Wheel Chair." Provisional Patent Application having application No. 62/917,373, filed Dec. 4, 2018, is fully incorporated herein by reference thereto as if repeated verbatim immediately herein. All benefits of the Dec. 4, 2018 filing date for the Provisional Patent Application is claimed.

BACKGROUND OF THE INVENTION

1. Field of the Invention

Embodiments of the present invention broadly relate to a motorized vehicle. More specifically, embodiments of the present invention provide a system and method for operating a motorized vehicle, such as a wheel chair.

2. Description of the Background Art

A motorized wheelchair is a wheelchair that is propelled by an electric motor which drives and rotates the wheels of the wheelchair. Motorized wheelchairs are used by people who are unable to propel a manual wheelchair, or who may need to use a wheelchair for long distances or over terrain which would be fatiguing in a manual wheelchair. Controllers for motorized wheel chairs are most typically an armrest mounted joystick which allows the user to tailor sensitivity of motion of the wheelchair or access multiple control modes.

SUMMARY OF EMBODIMENTS OF THE INVENTION

Embodiments of the present invention provide an assembly for operating a wheelchair. The assembly includes a support frame having a planar support surface and a motor support assembly slidably disposed on the planar support surface. A motor is supported by the motor support assembly. A pinion gear is operably coupled to the motor. The assembly further includes a linkage assembly for coupling the motor support assembly to the support frame. A handle member engages the linkage assembly and is adapted to move the motor support assembly along the surface of the planar support surface. In a preferred embodiment of the present invention, a wheelchair is provided with two generally identical assemblies for operating the wheelchair, a port assembly and a starboard assembly.

Embodiments of the present invention also provide a method for engaging gears of a motorized vehicle (e.g. a wheelchair) in general. The method comprises providing a motorized vehicle which includes a vehicle frame having a support frame with a planar surface, and a motor-pinion gear support assembly supporting a motor and a pinion gear. The method further comprises moving a handle generally upwardly, which causes a linkage assembly to slide the motor-pinion gear support assembly along the planar surface of the support frame until the pinion gear engages and meshes with a bull gear of the motorized vehicle. The bull gear has at least one (preferably 3) spoke-engaging coupler having a channel wherein a spoke of a wheel of the motorized vehicle lodges for securing the bull gear to the wheel. In a preferred embodiment, the spoke-engaging coupler is geometrically shaped as a forked or slotted rectangular block.

These provisions together with the various ancillary provisions and features which will become apparent to those artisans possessing skill in the art as the following description proceeds are attained by devices, assemblies, systems and methods of embodiments of the present invention, various embodiments thereof being shown with reference to the accompanying drawings, by way of example only and not by way of any limitation, wherein:

DETAILED DESCRIPTION OF EMBODIMENTS OF THE INVENTION

Figure 1:
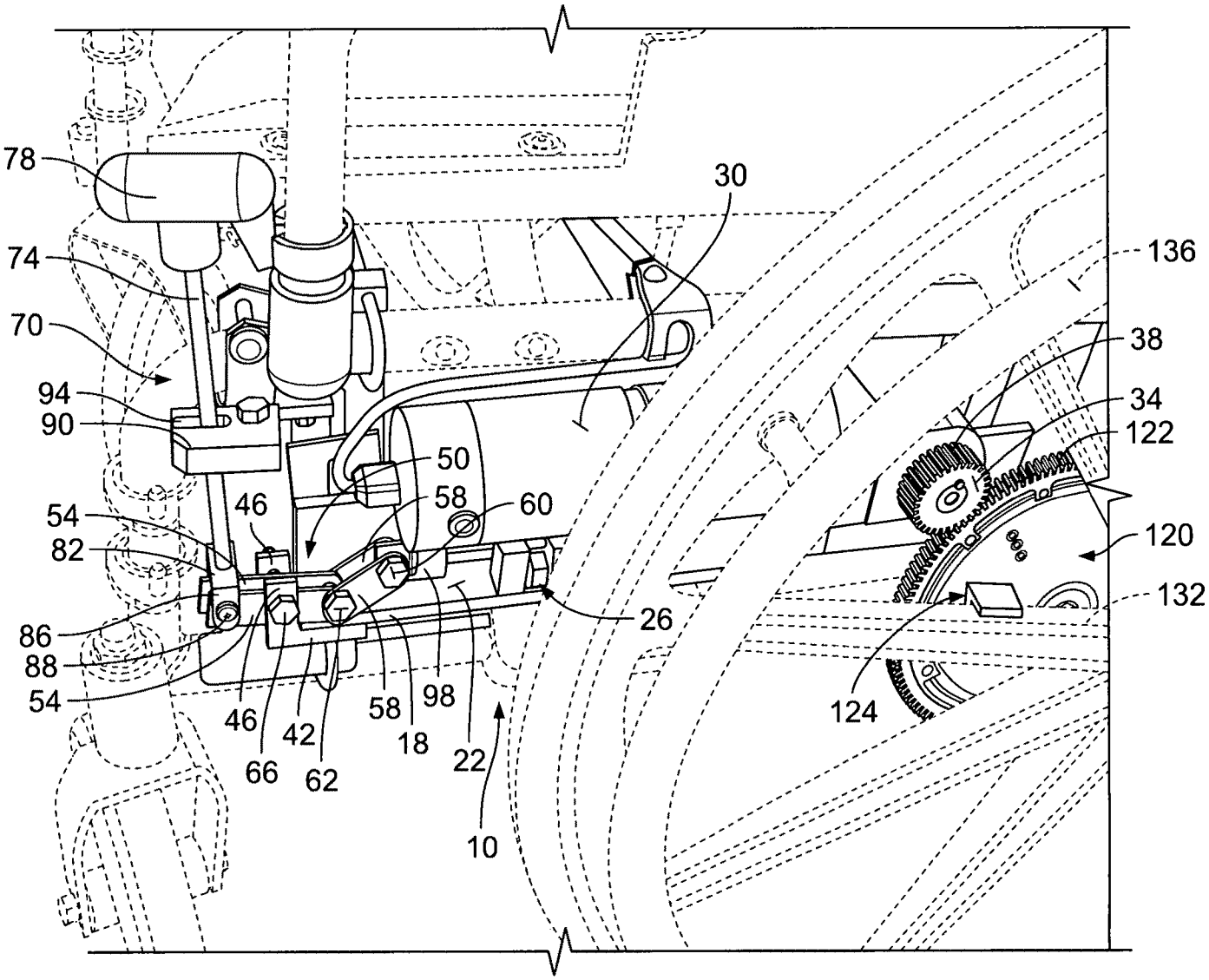
FIG. 1 is a partial perspective view of the operating system for a wheel chair illustrating the handle pulled back and upwardly which causes the motor to travel towards the bull gear and the pinion gear to engage the bull gear, placing the linkage in a concave shape and the wheel chair in a position to be operated by the joystick.
Figure 2:
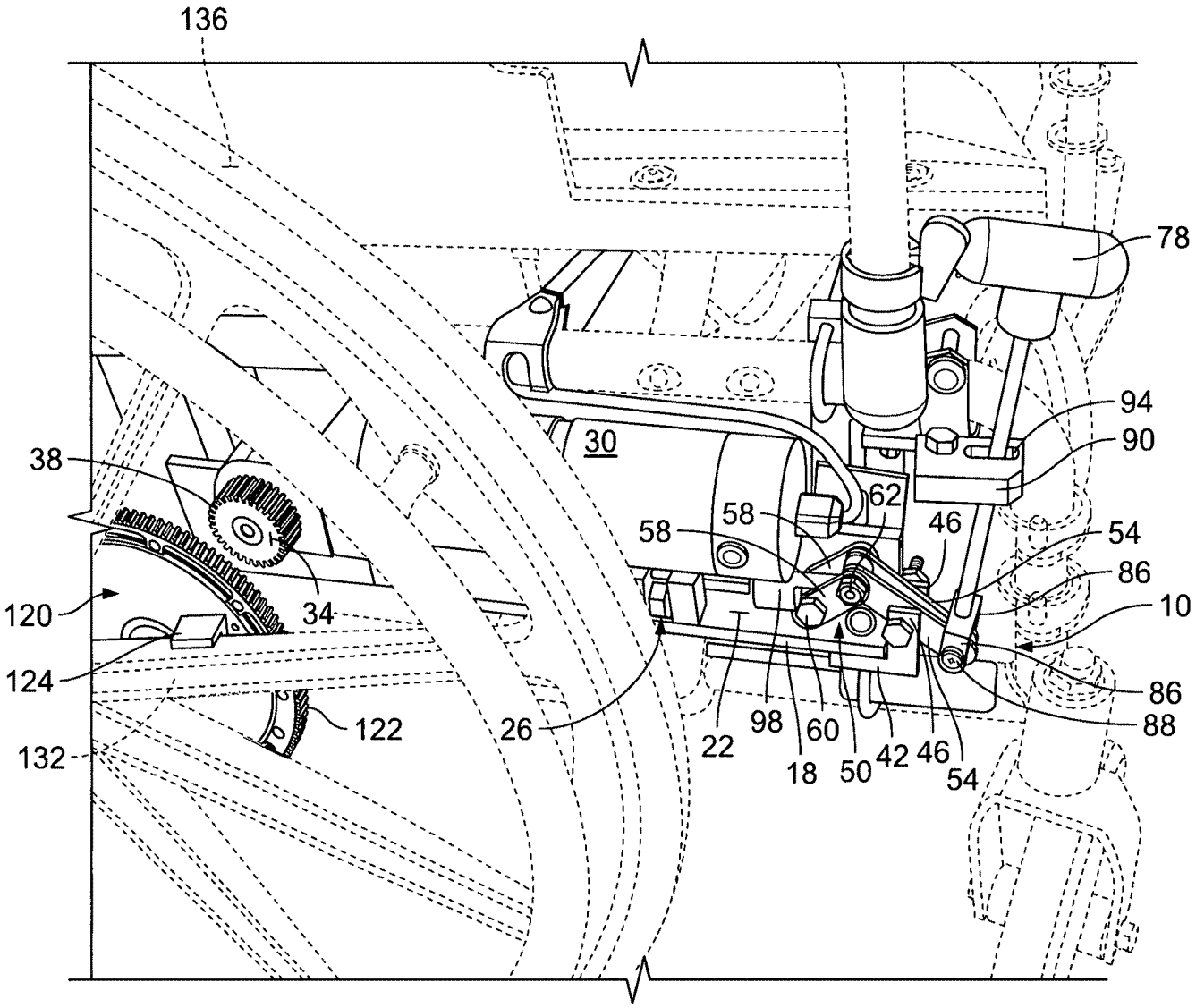
FIG. 2 is a perspective view of the operating system illustrating the handle pushed forward and downwardly, causing the linkage between the handle and the motor support base to arch into a generally convex shape and the pinion gear to become disengaged from the bull gear.

In the description herein for embodiments of the present invention, numerous specific details are provided, such as examples of components and/or methods, to provide a thorough understanding of embodiments of the present invention. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Referring in detail now to the drawings wherein similar parts of the invention are identified by like reference numerals, there is seen an assembly, generally illustrated as 10 (see FIG. 3), for operating a motorized vehicle, such as a motorized wheelchair 14. The assembly 10 comprises a support frame 18 which has a planar support surface 22, and a motor support assembly, generally illustrated as 26, for supporting a motor 30. The motor support assembly 26 is capable of being moved back and forth along the planar support surface 22. The motor 30 operates a pinion gear 34 which possesses circumferentially disposed teeth 38. A coupler 42 is connected to an end of the support frame 18. The coupler 42 is generally L-shaped and has a pair of parallel coupler arms 46-46.

A linkage assembly, generally illustrated as 50, is coupled to the motor support assembly 26 and to the support frame 18, more specifically to the coupler 42. The linkage assembly 50 comprises a pair of parallel coupler-engaging arms 54-54 and a pair of parallel spaced arms 58-58 pivotally coupled by bolt 62 to arms 54-54, respectively. The ends of arms 58-58 are pivotally coupled by bolt 60 to the motor support assembly 26. Bolt 66 passes through coupler arms 46-46 and through intermediate sections of coupler-engaging arms 54-54 to allow arms 54-54 to pivot between coupler arms 46-46 (as best shown in FIG. 1) and on bolt 60.

Assembly 10 further comprises a handle assembly, generally illustrated as 70, having a shaft 74, a grip member 78 secured to the top end of the shaft 74, and a generally U-shaped handle lug 82 connected to the bottom end of the shaft 74. Handle lug 82 has a pair of parallel lug arms 86-86 whose ends are respectively coupled to the ends of arms 54-54 by bolt 88. The ends of arms 54-54 reside within parallel lug arms 86-86. Lug arms 86-86 pivot about bolt 88, similarly to the intermediate section of arms 54-54 pivoting about bolt 66. The wheelchair 14 is provided with a frame member 90 having a slot 94 to guide the movement of the shaft 74 of the handle assembly 70.

Figure 3:
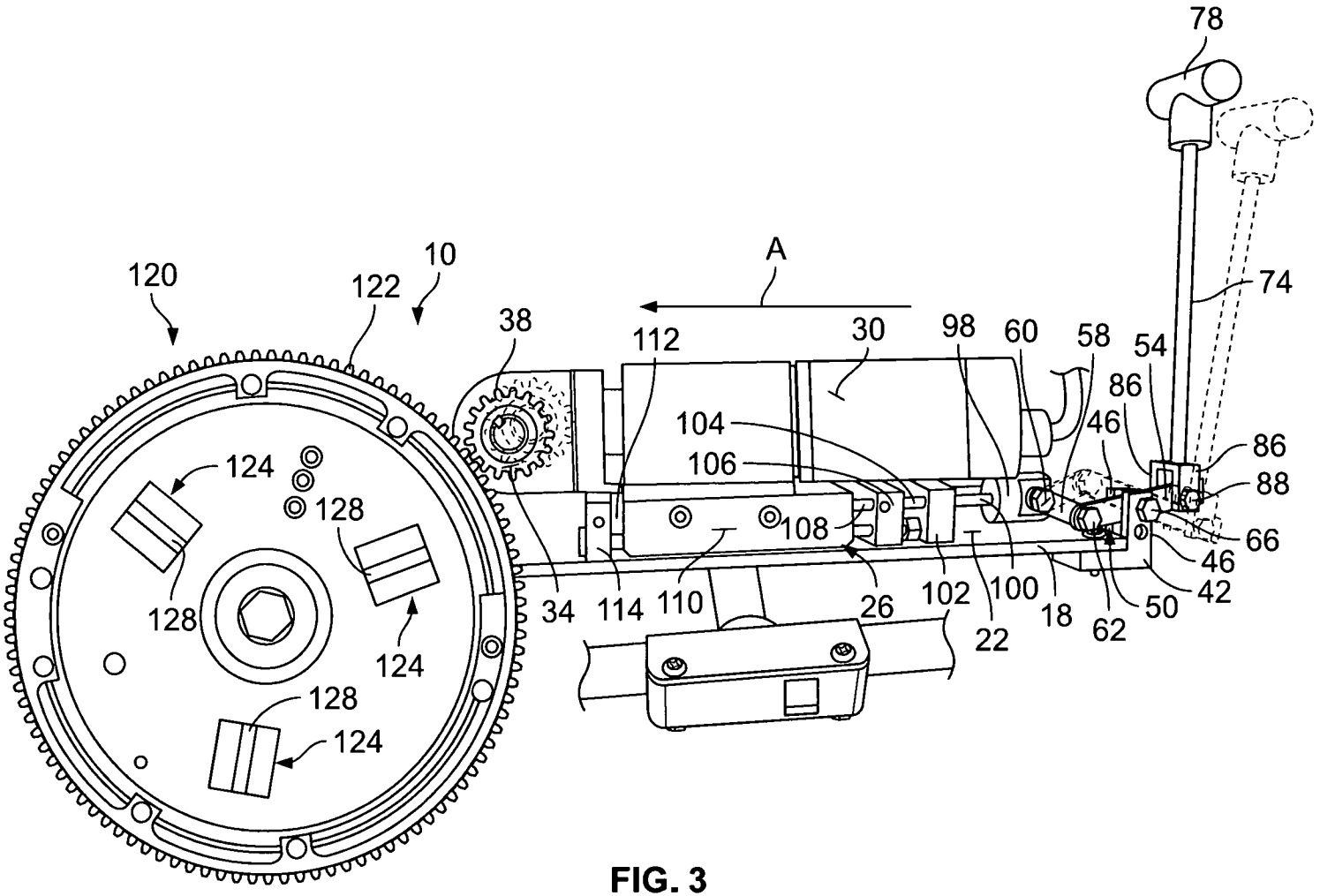
FIG. 3 is a side elevational view of the operating system for embodiments of the present invention, illustrating when the handle is pushed forward and downwardly into the dotted line position, the linkage (illustrated as dotted lines) between the handle and the motor support assembly is in a generally arch or generally convex shape and the pinion gear (illustrated as dotted lines) is disengaged from the bull gear; and when the handle is pulled back and upwardly into the solid line position, the motor travels in direction of the arrow A towards the bull gear to engage the pinion gear with the bull gear (illustrated as solid lines), placing the linkage (illustrated as solid lines) in a generally concave shape and the wheel chair in a position to be operated by the joystick.

As best shown in FIG. 3, the motor support assembly 26 comprises a support lug 98 which is disposed between arms 58-58. Bolt 60 passes through support lug 98 for allowing the ends of arms 58-58 to pivot about bolt 60. The motor support assembly 26 also comprises a front support block member 102 coupled to the support lug 98 by rod 100; an intermediary support block member 106 coupled to the first support block member 102 by rod 104; a motor support platform 110 coupled to the intermediary support block member 106 by rod 108; and a rear support block member 114 coupled to the motor support platform 110 by rod 112.

Figure 4:
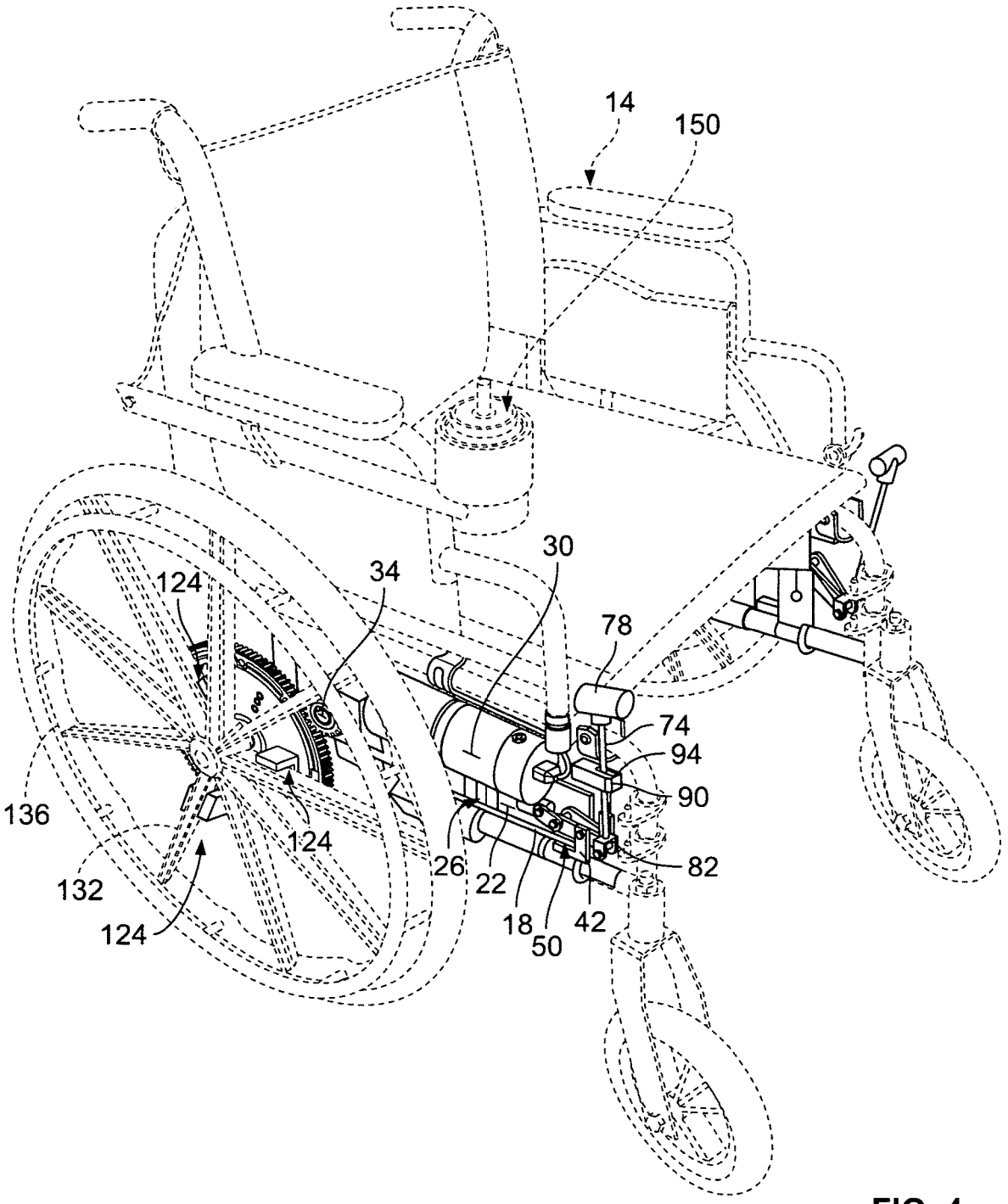
FIG. 4 is a perspective view of the wheelchair having the handle in an up position and the pinion gear engaged to the bull gear so the wheelchair can be moved by operating the joystick.
Figure 5:
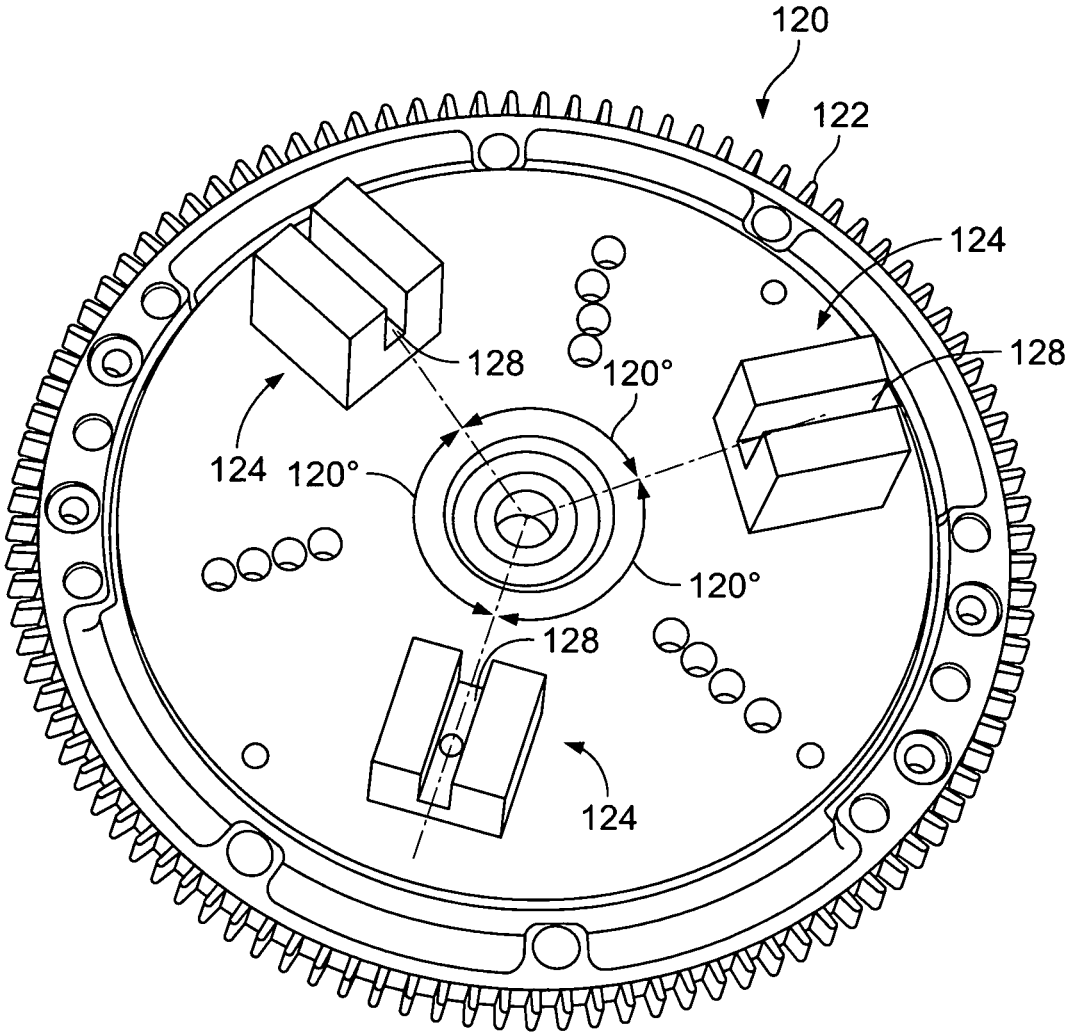
FIG. 5 is a perspective view of the bull gear having three spoke engaging couplers, each coupler being disposed generally equi-arcuately from each other at about 120 degrees and geometrically shaped as a block having a longitudinal channel wherein a spoke of the wheel of the wheelchair lodges for coupling the bull gear to the wheel.

The assembly 10 additionally comprises a bull gear, generally illustrated as 120, which is adapted for engaging the pinion gear 34 to place the wheelchair 14 in a position to be operated and moved by the joystick 150 (see FIG. 4). As best shown in FIG. 5, the bull gear 120 has teeth 122 surrounding its circumference for engaging and meshing with the teeth 38 of the pinion gear 34, as illustrated in FIGS. 1 and 3. The bull gear 120 also has spoke-engaging couplers 124, each being geometrically shaped as a block having a longitudinal channel 128 wherein a spoke 132 of a wheel 136 of the wheelchair 14 lodges for coupling the bull gear 120 to the wheel 136. In a preferred embodiment of the invention and as further best shown in FIG. 5, each coupler 124 is disposed generally equi-arcuately from each other at about 120 degrees. Contiguous axii through the longitudinal channels 128 are preferably arcuately separated by about 120 degrees.

Continuing to refer to FIG. 3 for illustrating the operating system for embodiments of the present invention, when the handle assembly 70 is pushed forward and downwardly, it is placed in a position represented by dotted lines in FIG. 3. In this dotted line position, the linkage assembly 50 (also illustrated as dotted lines) between the handle assembly 70 and the motor support assembly 26 is simultaneously in a generally arch or generally convex shape, and the pinion gear 34 (illustrated as dotted lines) is disengaged from the bull gear 120. When the handle assembly 70 is pulled back and upwardly into the solid line position, the motor support assembly 26 and the motor 30 travel in direction of the arrow A towards the bull gear 120, causing the pinion gear 34 to engage and mesh with the bull gear 120 (illustrated as solid lines), placing the linkage assembly 50 (illustrated as solid lines) in a generally concave shape and the wheel chair 14 in a position to be operated by the joystick 150. Reversing the procedure by pushing the handle assembly 70 forward and downwardly again, causes the motor support assembly 26 and the motor 30 to move in a direction opposite to the direction indicated by arrow A and the disengagement of the pinion gear 34 with the bull gear 120.

Moving the handle assembly 70 generally upwardly causes the coupler-engaging arms 54-54 (i.e., a first arm assembly) of the linkage assembly 50 to pivot within the pair of lug arms 86-86 of the handle lug member 82 while simultaneously intermediary sections of the coupler-engaging arms 54-54 (i.e., the first arm assembly) pivot within the pair of generally parallel coupler arms 46-46 of the coupler 42 which is secured to the support frame 18. Simultaneously also, opposed ends of the coupler-engaging arms 54-54 pivot respectively about ends of arms 58-58 (i.e., a second arm assembly) of the linkage assembly 50 while opposed ends of arms 58-58 pivot about the support lug 98 of the motor support assembly 26. As previously indicated, the wheel 136 of the wheelchair 14 rotates when the bull gear 120 rotates, through the steadfast engagement of the couplers 124 with spokes 132.

Reference throughout the specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

Additionally, any signal arrows in the drawings/Figures should be considered only as exemplary, and not limiting, unless otherwise specifically noted. Furthermore, the term "or" as used herein is generally intended to mean "and/or" unless otherwise indicated. Combinations of components or steps will also be considered as being noted, where terminology is foreseen as rendering the ability to separate or combine is unclear.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims.

What is claimed is:

1. An assembly for operating a wheelchair comprising:

(a) a support frame having a planar support surface;

(b) a motor support assembly slidably disposed on the planar support surface;

(c) a motor supported by the motor support assembly such as to move simultaneously with the motor support assembly when the motor support assembly is moved along the planar support surface of the support frame;

(d) a pinion gear coupled to the motor;

(e) a linkage assembly coupled to the motor support assembly and to the support frame; and (f) a handle member coupled to the linkage assembly and adapted to simultaneously move the motor support assembly and the motor supported by the motor support assembly.

2. The assembly of claim 1 wherein said linkage assembly comprises a generally concave shape.

3. The assembly of claim 1 wherein said linkage assembly comprises a generally convex shape.

4. The assembly of claim 1 wherein said linkage assembly comprises a first arm assembly coupled to the support frame and to the handle member, and a second arm assembly coupled to the motor support assembly and to the first arm assembly.

5. The assembly of claim 4 additionally comprising a coupler connected to the support frame, said coupler comprises a pair of generally parallel coupler arms where between said first arm assembly pivotally moves.

6. The assembly of claim 4 wherein said handle member comprises a handle lug member having a pair of generally parallel lug arms where between said first arm assembly is pivotally coupled to said handle.

7. The assembly of claim 4 wherein said motor support assembly comprises a support lug, said second arm assembly of said linkage assembly pivotally connects to said support lug.

8. The assembly of claim 4 wherein said motor support assembly comprises a support lug, a front support block member coupled to said support lug, an intermediary support block member coupled to the first support block member, a motor support platform coupled to the intermediary support block member, and a rear support block member coupled to the motor support platform.

9. The assembly of claim 1 additionally comprising a bull gear adapted for engaging the pinion gear, said bull gear having at least one spoke-engaging coupler being geometrically shaped as a block having a longitudinal channel wherein a spoke of a wheel of the wheelchair lodges for coupling the bull gear to the wheel.

10. The assembly of claim 9 wherein said at least one spoke-engaging coupler comprises three spoke engaging couplers, each coupler being disposed generally equi-arcuately from each other at about 120 degrees and geometrically shaped as a block having a longitudinal channel wherein a spoke of the wheel of the wheelchair lodges for coupling the bull gear to the wheel.

11. A method for engaging gears in a motorized vehicle comprising:

(a) providing a motorized vehicle comprising a vehicle frame having a support frame with a planar surface, and a motor-pinion gear support assembly supporting a motor and a pinion gear; and (b) moving a handle generally upwardly to cause a linkage assembly to slide the motor-pinion gear support assembly and the motor and the pinion gear along the planar surface of the support frame until the pinion gear engages and meshes with a bull gear of the motorized vehicle, said bull gear comprising at least one spoke-engaging coupler having a channel wherein a spoke of a wheel of the motorized vehicle lodges for coupling the bull gear to the wheel.

12. The method of claim 11 additionally comprising moving the linkage assembly from a generally convex disposition into a concave disposition.

13. The method of claim 11 where said moving said handle generally upwardly causes a first arm of the linkage assembly to pivot within a pair of lug arms of a handle lug member while simultaneously an intermediary section of the first arm pivots within a pair of generally parallel coupler arms of a coupler secured to the support frame, simultaneously with an opposed end of the first arm member pivoting about an end of a second arm of the linkage assembly while simultaneously further an opposed end of the second arm pivots about a support lug of the motor-pinion gear support assembly.

14. The method of claim 13 additionally comprising rotating a wheel of the motorized vehicle with at least one spoke-engaging coupler secured to the bull gear, said coupler being geometrically shaped as a block having a longitudinal channel wherein a spoke of the wheel of the motorized vehicle lodges.

15. The method of claim 14 wherein said at least one spoke-engaging coupler comprises three spoke engaging couplers, each coupler being disposed generally equi-arcuately from each other at about 120 degrees and geometrically shaped as a block having a longitudinal channel wherein a spoke of the wheel of the wheelchair lodges for coupling the bull gear to the wheel.

16. A wheel chair comprising:

(a) a wheel-chair frame assembly comprising a first support frame having a first planar support surface and a second support frame having a second planar support surface;

(b) a first motor support assembly slidably disposed on the first planar support surface, and a second motor support assembly slidably disposed on the second planar support surface;

(c) a first motor supported by the first motor support assembly such as to move simultaneously with the first motor support assembly when the first motor support assembly is moved along the first planar support surface of the first support frame, and a second motor supported by the second motor support assembly such as to move simultaneously with the second motor support assembly when the second motor support assembly is moved along the second planar support surface of the second support frame;

(d) a first pinion gear coupled to the first motor, and a second pinion gear coupled to the second motor;

(e) a first linkage assembly coupled to the first motor support assembly and to the first support frame, and a second linkage assembly coupled to the second motor support assembly and to the second support frame; and (f) a first handle member coupled to the first linkage assembly and adapted to simultaneously move the first motor support assembly and the first motor supported by the first motor support assembly, and a second handle member coupled to the second linkage assembly and adapted to simultaneously move the second motor support assembly and the second motor supported by the second motor support assembly.

17. The wheel chair of claim 16 additionally comprising a first bull gear adapted for engaging the first pinion gear, said first bull gear having three first spoke-engaging couplers, each first coupler being geometrically shaped as a rectangular block having a first longitudinal channel wherein a spoke of a first wheel of the wheelchair lodges for coupling the first bull gear to the first wheel.

18. The wheel chair of claim 17 additionally comprising a second bull gear adapted for engaging the second pinion gear, said second bull gear having three second spoke-engaging couplers, each second coupler being geometrically shaped as a rectangular block having a second longitudinal channel wherein a spoke of a second wheel of the wheelchair lodges for coupling the second bull gear to the second wheel.

19. The wheel chair of claim 18 wherein each second spoke-engaging coupler of said three second spoke-engaging couplers being disposed generally equi-arcuately from each other at about 120 degrees and geometrically shaped as a block having the second longitudinal channel wherein a spoke of the second wheel of the wheelchair lodges for coupling the second bull gear to the second wheel.

20. The wheel chair of claim 17 wherein each first spoke-engaging coupler of said three first spoke-engaging couplers being disposed generally equi-arcuately from each other at about 120 degrees and geometrically shaped as a block having the first longitudinal channel wherein a spoke of the first wheel of the wheelchair lodges for coupling the first bull gear to the first wheel.

* * * * *